United States Patent [19]

Gray

[11] 3,984,673

[45] Oct. 5, 1976

[54] EXTERNAL LIGHTING SYSTEM FOR HYPOBARIC AND HYPERBARIC CHAMBERS

[75] Inventor: Kenneth O. Gray, Oxnard, Calif.

[73] Assignee: The United States of America as represented by the Secretary of the Navy, Washington, D.C.

[22] Filed: June 30, 1975

[21] Appl. No.: 591,586

[52] U.S. Cl. ..... 240/2 R; 240/41.1; 240/47

[51] Int. Cl.[2] ..... F21V 33/00

[58] Field of Search ..... 240/2 R, 1 R, 2 LC, 240/41.1, 47, 26

[56] References Cited

UNITED STATES PATENTS 3,586,851 6/1971 Rudolph ..... 240/47

*Primary Examiner*—R L Moses

*Attorney, Agent, or Firm*—Richard S. Sciascia; Joseph M. St.Amand

[57] ABSTRACT

A compact and safe means for providing high intensity cold light to illuminate hyperbaric chambers. The lighting system is comprised of a high intensity light source and a dichroic mirror enclosed in a housing which permits easy attachment to a viewport on a hyperbaric chamber.

15 Claims, 3 Drawing Figures

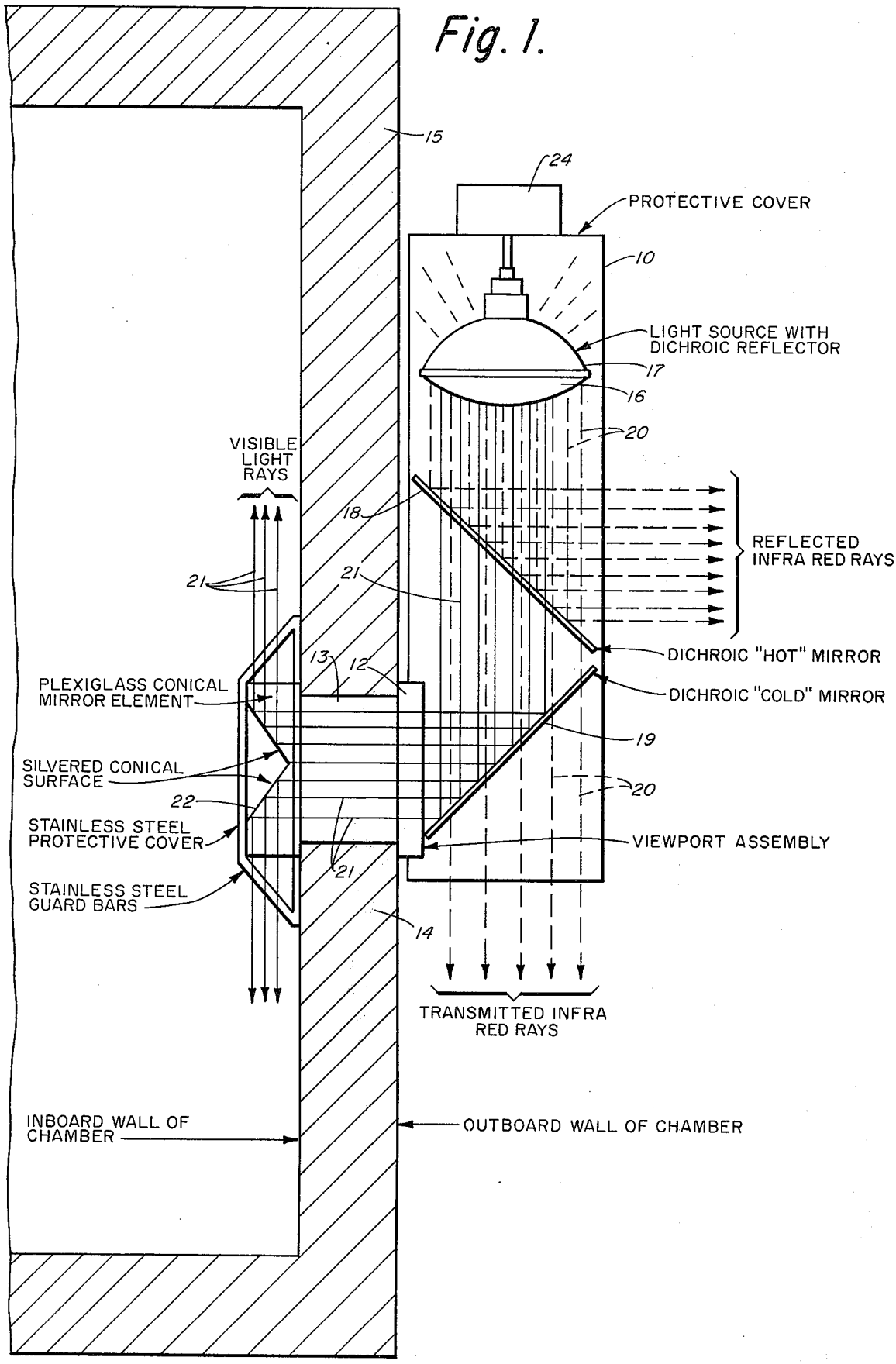
Fig. 1.
15
24
PROTECTIVE COVER
10
LIGHT SOURCE WITH DICHROIC REFLECTOR
17
16
20
VISIBLE LIGHT RAYS
18
REFLECTED INFRA RED RAYS
21
21
DICHROIC "HOT" MIRROR
13
12
PLEXIGLASS CONICAL MIRROR ELEMENT
DICHROIC "COLD" MIRROR
19
SILVERED CONICAL SURFACE
20
22
STAINLESS STEEL PROTECTIVE COVER
VIEWPORT ASSEMBLY
21
STAINLESS STEEL GUARD BARS
14
TRANSMITTED INFRA RED RAYS
INBOARD WALL OF CHAMBER
OUTBOARD WALL OF CHAMBER

EXTERNAL LIGHTING SYSTEM FOR HYPOBARIC AND HYPERBARIC CHAMBERS

BACKGROUND OF THE INVENTION

This invention relates to lighting systems and particularly to a lighting system designed to operate through a viewport and to provide illumination to the interior of hypobaric or hyperbaric chambers from a light source located outside the wall of the chamber. Hyperbaric research, diver recompression chambers, and the like require safe and effective means for internal illumination. A hyperbaric chamber is designed to withstand internal pressures greater than atmospheric. A hypobaric chamber is designed to withstand internal pressures less than atmospheric. Waterfilled hyperbaric chambers are frequently used for diver research and the like.

Several methods have been used for illuminating hypobaric and hyperbaric chambers. Incandescent lamps generally enclosed in protective enclosures have been commonly used for internally located light sources. These light sources have introduced electrical and fire hazards into the chambers. In addition, the heat generated by the light source was dissipated into the chamber, thus adding to the heat load in the system. All systems which use internally located light sources have required extra openings through the chamber wall to provide electrical power to the lights.

A wide variety of commercial incandescent lamps have been used with externally located light sources for introducing light to the interior of hyperbaric or hypobaric chambers through viewports. The most common problem has been the heating of the viewport by infrared radiation which accompanies the visible light. This can cause severe thermal stresses in the viewport material and has on occasion resulted in the cracking of the viewports; plastic viewports have sometimes been fused or charred on the surface. Such overheating and subsequent mechanical damage can lead to the catastrophic failure of the viewport and the loss of life and property. Attempts to prevent overheating of the viewports have included: the use of low power lamps which give off less heat and less light; the spacing of the light source at a greater distance from the viewport with subsequent reduction in both heating and lighting effect; and the use of infrared absorbing glass to extract the heat which requires the heat absorbed by the glass to in turn be dissipated by a heat sink or other method.

Additional problems occur in water-filled hyperbaric chambers (WET POTS) where light directed into the water-filled chamber directly illuminates minute particles of matter in the water, making it difficult for divers working within such a chamber or persons looking through viewports to see properly due to excessive reflection of light from the minute particles of matter.

SUMMARY OF THE INVENTION

This invention is for an externally generated lighting system to provide illumination to the interior of hypobaric or hyperbaric chambers and the like through viewports in the walls of the chambers. The lighting system comprises a high intensity light source and a dichroic mirror arrangement designed for heat extraction and delivery of a relatively cold light through a chamber viewport in a safe and convenient manner. Visible light from the source is directed through one or more dichroic reflectors positioned to separate visible light from the infrared radiation and direct the visible light through the viewport. A conical mirror is used to divert the light sideways within the chamber.

BRIEF DESCRIPTION OF THE DRAWINGS

FIG. 1 is a diagrammatic illustration of a preferred embodiment of the invention.

DETAILED DESCRIPTION OF THE PREFERRED EMBODIMENT

Figure 2:
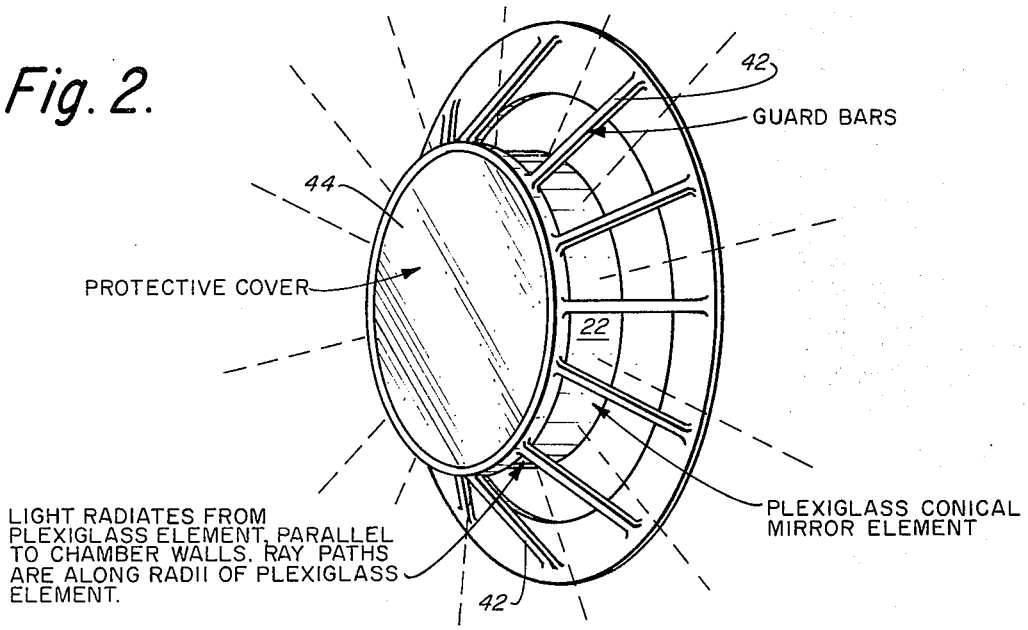
FIG. 2 is a more detailed illustration of the conical mirror element shown in the embodiment of FIG. 1.

This invention is an externally generated light (EGL) lighting system for hyperbaric or hypobaric chambers and the like wherein the lighting system provides light to the interior of a chamber through any of the viewports in the chamber wall. As is illustrated in FIG. 1, a protective cover or housing 10, containing the lighting system, is attached to the outer rim 12 of a viewport 13 in wall portion 14 of a chamber 15. A light source 16, such as a reflectorized PAR-type light bulb or a standard light bulb with a reflector is mounted within housing 10. Visible light from source 16 is directed by dichroic reflector 17 through one or more dichroic reflectors: dichroic "hot" mirror 18 and dichroic "cold" mirror 19. Dichroic hot mirror 18 can be omitted in some instances. These dichroic mirrors are positioned so that the heat, as represented by the infrared radiation, lines 20, accompanying the visible light, lines 21, is separated from the visible light and directed away from viewport 13, and the visible light 21 is directed through the viewport. A conical mirror element 22, of plexiglass, glass or other suitable optical material, may be mounted on the inboard wall of chamber 15 to divert visible light rays 21 from directly illuminating particles of matter that may be suspended in water within the chamber. Additional details of conical mirror element 22 is illustrated in FIG. 2. Where there are no foreign particles in the water or when the chamber is not filled with water, as in FIG. 3, the conical mirror element may be omitted.

A control unit 24 is provided for switching light source 16 on or off and for varying the intensity of the light, such as by means of a dimmer control. Control unit 24 may also include a mercury switch for turning off the power in situations where the lighting system is moved out of service position.

Figure 3:
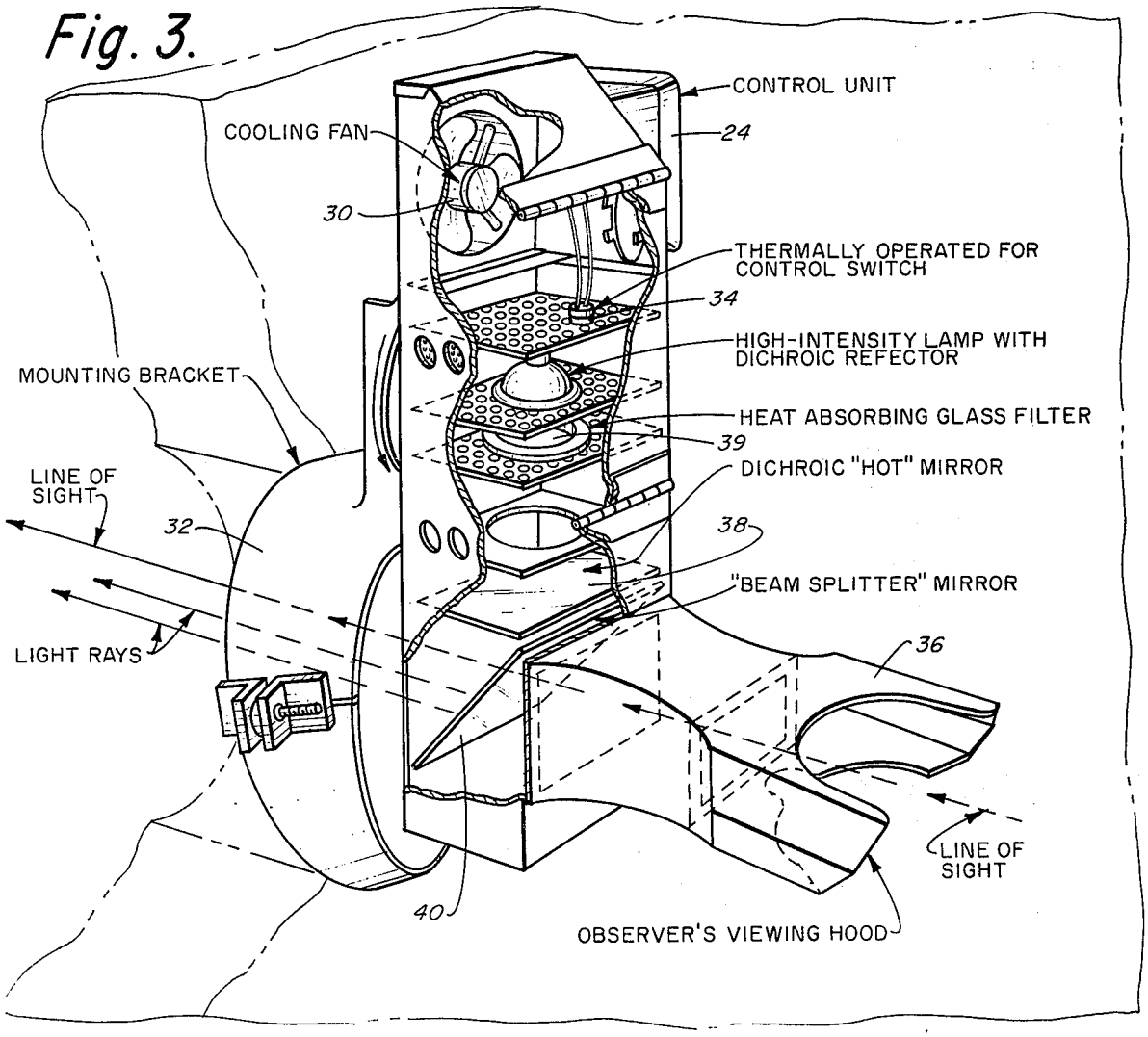
FIG. 3 illustrates another embodiment of a hyperbaric chamber lighting system of the present invention for simultaneous lighting and viewing through a chamber viewport

Housing 10 may be of sheet metal or insulated material and can be vented to allow air circulation and cooling. A fan 30 for forced cooling may be used, as shown in FIG. 3, when rapid cooling is desired. A mounting bracket 32 on viewport rim 12 can be provided to permit rotating the light housing away from the viewport in order that the viewport will be clear for viewing when the light system is not required.

The EGL lighting system described herein uses a parabolic or other curved dichroic reflector 17 with light source 16 to concentrate the light into a beam without concentrating the infrared radiation given off by the lamp filament. The flat dichroic reflector (cold mirror 19) serves to bend the visible light beam 90° and direct it through viewport 13 while allowing the greater part of the infrared radiation remaining in the light beam to pass through cold mirror 19 and be disposed of away from the viewport.

By incorporating the use of dichroic hot mirror 18 between light source 16 and dichroic cold mirror 19, as shown in FIG. 1, additional infrared radiation is reflected away and thus extracted from the light beam prior to reaching cold mirror 19.

The use of a dichroic hot mirror 38 for additional light filtration plus the use of a cooling fan 30, controlled by a thermal switch 34, as shown in FIG. 3, provides further reduction of the heat input to the viewport 13 and alternately permits the use of a more powerful light source.

The use of the cold mirror to dispose of unwanted infrared radiation and to bend the light beam by 90° permits this EGL system to be conveniently mounted in such a manner that it does not protrude from the side of the chamber to which it is attached and thus obstruct traffic. This is especially important in many hyperbaric decompression chamber installations as they are frequently crowded into small compartments aboard ships or in mobile vans. The EGL mounting system is normally mounted so that the housing may be easily unlocked, rotated out of operating position and locked into an out-of-service position which then permits access to the viewport for cleaning or observation purposes. Light intensity control unit 24 permits variation of the light intensity to suit the requirements of the chamber operators. Control system 24 also incorporates an automatic switching device which turns the light off when it is rotated out of the using position and into the out-of-service position. This device turns the power back on when the unit is restored to its operating position. The use of dichroic reflectors in this chamber lighting system results in the construction of a more compact lighting system and provides high intensity light with lower heat input to the viewport.

As shown in FIG. 3, the lighting system can be simultaneously used with an observer's viewing hood 36. With this embodiment, the conical mirror element 22 is not used in order to permit direct viewing into chamber 15. The line of sight through the viewport is substantially the same as the direction of the reflected visible light rays.

In the embodiment of FIG. 3, a dichroic hot mirror 38 is positioned to reflect infrared rays back past the light source and toward the cooling system. An infrared heat absorbing glass filter 39 is also used. By incorporating an infrared absorbing filter 39 into the light path and replacing the 45° inclined cold mirror with an 80% reflecting — 20% transmitting "beam splitting" mirror 40, the system can be modified for use in simultaneously lighting and viewing the interior of the chamber.

By using high intensity discharge lamps in place of incandescent lamps, the heat generated by the light source can be significantly reduced and the lamp life and reliability greatly increased, particularly in high vibration environments.

The conical mirror element 22 used in the embodiment of FIG. 1 and further illustrated in FIG. 2 can be fabricated of plexiglass with a silvered conical surface for deflecting light sideways from the direction of impingement. Visible light from the source which passes through the viewport will impinge upon the silvered conical surface and be radiated from the conical mirror element substantially parallel to the inboard walls of chamber 15 to light the interior of the chamber. Light ray paths are substantially along radii of the conical mirror element. Guard bars 42 and a protective cover 44 of non-corrosive material such as stainless steel may be provided to protect the conical element.

Obviously many modifications and variations of the present invention are possible in light of the above teachings. It is therefore to be understood that within the scope of the appended claims the invention may be practiced otherwise than as specifically described.

I claim:

1. In a pressure chamber of the hypobaric/hyperbaric type having at least one viewport in the chamber wall, the improvement being an external lighting system for illuminating the interior of the chamber, comprising:

a. a compact housing mounted over the viewport on the outside of an hypobaric/hyperbaric type chamber wall;

b. a light source within said housing for directing light rays in a substantially parallel beam;

c. beam splitting reflector means positioned within said housing at an angle to said viewport and said light source which reflects a portion of the light from said light source through said viewport to the interior of said chamber and transmits a portion of the light from said source away from said viewport;

d. said beam splitting reflector means simultaneously reflecting light to the interior of said chamber and being partially transparent to permit viewing through said viewport; the line of sight for viewing being angularly through said beam splitting reflector means and directly through said viewport;

e. a dichroic hot reflector means, which reflects infrared radiation and passes visible light rays, positioned between said light source and said beam splitting reflector means for extracting a portion of the infrared radiation from the light source prior to its reaching said beam splitting reflector means.

2. A device as in claim 1 wherein said housing is provided with an observer's viewing hood for viewing into the interior of said chamber while it is simultaneously being illuminated from said light source.

3. A device as in claim 1 wherein said beam splitting reflector means comprises a dichroic cold reflector means which reflects visible light rays and passes infrared radiation for reflecting visible light rays from said light source through said viewport and simultaneously transmitting infrared rays from the light source therethrough and away from the viewport.

4. A device as in claim 1 wherein said beam splitting reflector means is 80% reflecting and 20% transmitting.

5. A device as in claim 1 wherein said light source is provided with a dichroic reflector means.

6. A device as in claim 1 wherein cooling means is provided for directing heat and infrared radiation away from said housing and viewport.

7. A device as in claim 1 wherein control means is provided for controlling the power to said light source and varying the intensity of the light emanating therefrom.

8. A device as in claim 1 wherein said housing is mounted over said viewport by means which permits the housing to be rotated away from the viewport.

9. A device as in claim 1 wherein a heat absorbing filter is interposed in the light beam between said light source and reflector means in the system.

10. In a water-filled hyperbaric chamber having at least one transparent viewport in the chamber walls, the improvement being an external lighting system for illuminating the interior of the chamber comprising:

a. a compact housing mounted over the viewport on the outside of a chamber wall;

b. a light source within said housing having a reflector for directing light rays in a substantially parallel beam;

c. a dichroic cold reflector means, which reflects visible light rays and passes infrared radiation, positioned within said housing at an angle to said viewport and said light source for reflecting visible light rays from said light source through said viewport and simultaneously transmitting infrared rays from the light source through said dichroic cold reflector away from the viewport;

d. a dichroic hot reflector means which reflects infrared radiation and passes visible light rays positioned between said light source and said dichroic cold reflector for extracting a portion of the infrared radiation from the light source beam prior to its reaching said dichroic cold reflector;

e. a conical mirror element mounted over said viewport on the interior wall of said chamber for directing visible light rays which pass through said viewport radially from the conical mirror element and substantially parallel to said interior chamber wall, thus preventing visible light radiation which passes through the viewport form directly illuminating foreign particles of matter that may be suspended in the water in said chamber and otherwise interfere with visibility therein.

11. A device as in claim 10 wherein said beam splitting reflector means is 80% reflecting and 20% transmitting.

12. A device as in claim 10 wherein said light source is provided with a dichroic reflector means. provided with a dichroic reflector means.

13. A device as in claim 10 wherein cooling means is provided for directing heat and infrared rediation away from said housing.

14. A device as in claim 10 wherein a heat absorbing filter is interposed in the light beam between said light source and reflector means in the system.

15. In a pressure chamber of the hypobaric/hyperbaric type having at least one viewport in the chamber wall, the improvement being an external lighting system for illuminating the interior of the chamber, comprising:

a. a compact housing mounted over the viewport on the outside of an hypobaric/hyperbaric type chamber wall;

b. a light source within said housing for directing light rays in a substantially parallel beam;

c. beam splitting reflector means positioned within said housing at an angle to said viewport and said light source which reflects a portion of the light from said light source through said viewport to the interior of said chamber and transmits a portion of the light from said source away from said viewport;

d. a conical mirror element mounted over said viewport on the interior wall of said chamber which directs visible light rays which pass through the viewport radially from the conical mirror element and substantially parallel to the interior chamber wall.

* * * * *